United States Patent [19]

Dickson et al.

[11] 4,389,258

[45] Jun. 21, 1983

[54] METHOD FOR HOMOGENIZING THE STRUCTURE OF RAPIDLY SOLIDIFIED MICROCRYSTALLINE METAL POWDERS

[75] Inventors: James Dickson, Stirling; Kenji Okazaki, Rockaway Township, Morris County, both of N.J.; Thomas H. Sanders, Lafayette, Ind.

[73] Assignee: Allied Corporation, Morris Township, N.J.

[21] Appl. No.: 334,624

[22] Filed: Dec. 28, 1981

[51] Int. Cl.[3] ..... B22F 9/08; B22F 9/04

[52] U.S. Cl. ..... 148/3; 420/550; 75/251; 75/0.5 BA

[58] Field of Search ..... 164/46, 47; 148/3; 75/138, 0.5 R, 0.5 BA, 0.5 B, 25, 255; 264/8

[56] References Cited

U.S. PATENT DOCUMENTS

| | | | |
|---|---|---|---|
| 3,899,820 | 8/1975 | Read et al. | 29/420.5 |
| 4,259,270 | 3/1981 | Winter | 264/8 |
| 4,297,135 | 10/1981 | Giessen et al. | 75/123 B |

*Primary Examiner*—L. Dewayne Rutledge
*Assistant Examiner*—Christopher W. Brody
*Attorney, Agent, or Firm*—Michael J. Weins; Gerhard H. Fuchs

[57] ABSTRACT

The present invention is for an improved aluminum alloy powder for making consolidated products with an improved combination of strength and ductility. The alloy is cast as ribbon or flake which subsequently pulverized.

8 Claims, 6 Drawing Figures

1/4

METHOD FOR HOMOGENIZING THE STRUCTURE OF RAPIDLY SOLIDIFIED MICROCRYSTALLINE METAL POWDERS

DESCRIPTION

1. Field of Invention

This invention relates to a method for the production of rapidly solidified aluminum alloy powders which possess a uniform distribution of precipitates.

2. Background Art

High-strength aluminum-transition metal alloys have been produced by rapid solidification techniques, such as gas atomization and splat quenching. It has been recognized that the cooling rate of gas atomized materials is slower than that of splat quenched materials, and gas atomization produces a cast structure which is substantially coarser than the cast structure of splat quenched materials. Thus, it was commonly felt that the optimium properties of an alloy could be obtained by splat quenching.

Comparative studies have been conducted on consolidated aluminum-transition metal powders which bring the premise that optimium properties result from powders which are splat quenched, into question. At the Second International Conference on Rapid solidification T. H. Sanders et al., and H. G. Paris et al., noted that the more uniform solidification structures of atomized powders produced higher strengths than unclassified splat quenched alloys.

The work of Sanders et al., and of Paris et al., are reported in *Rapid Solidification Processings Principles and Technology,* No. 2, Re: pp 141–152 and pp 331–340 (Baton Rouge Publishing Division 1980).

Sanders et al. on page 151 summarized the finding on strength as follows.

> "Though splat theoretically results in a higher rate of solidification compared to atomization, the splat process leads to a broader particle size distribution than the atomization process. Consequently, under similar conditions of fabrication, the more uniform solidification of the atomizing process results in higher yield and tensile strengths than when the particulate is produced by the splat process."

In view of the above findings, it is apparent that there is a need to obtain a processing method that will fully utilize the potentially greater cooling rate obtainable by quenching onto a substrate.

SUMMARY OF THE INVENTION

The present invention is an improved method for the production of aluminum alloy powder to be used for the production of consolidated high strength aluminum products. The alloy is quenched on a chill surface to form ribbon or flake which is subsequently pulverized to produce powder. The improvement consists of grinding the ribbon or flake to produce a powder with a coarse and a fine component. The resulting coarse powder component has a coarse microstructure. Separating out the coarse component leaves a powder with a fine uniform structure.

It has been found that removal of the coarse component produces a uiform fine microstructure which substantially increases ductility of the consolidated product.

BEST MODES FOR CARRYING THE INVENTION INTO PRACTICE

Figure 1:
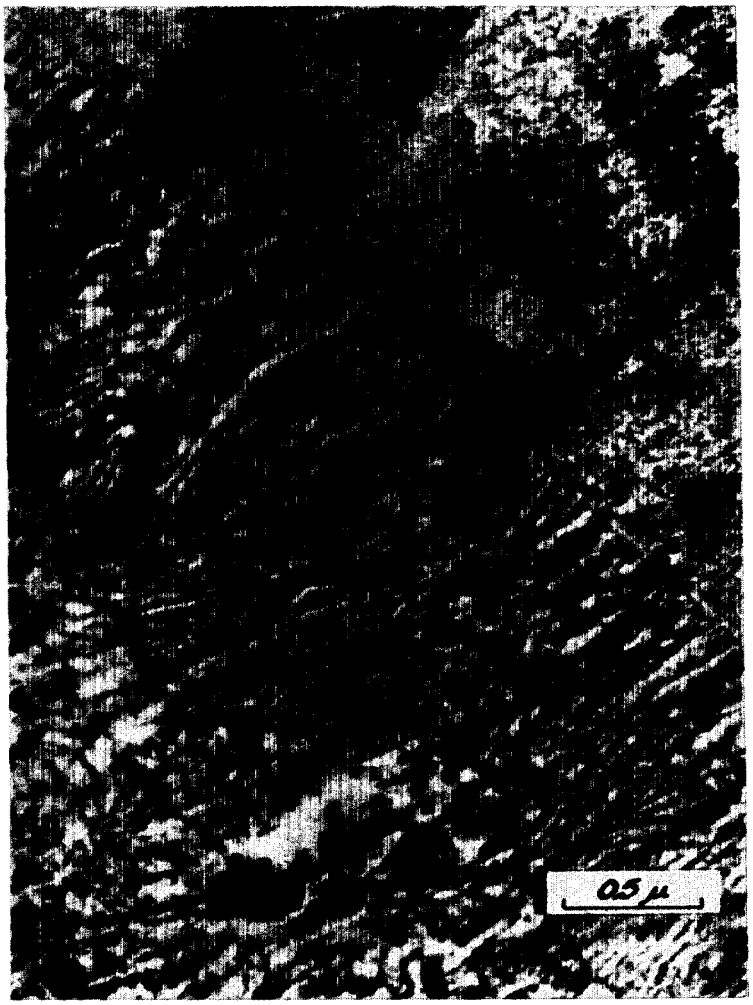
FIG. 1 is a micrograph of a section of a rapidly solidified ribbon. The micrograph shows regions of fine and coarse structure.

The powders of the present invention are produced by casting alloys onto a chill surface. The cast material is crystalline in form and has a spatially non-uniform distribution of precipitates. The materials may be cast by splat quenching; however, it is preferred that the material be cast in continuous form either by jet casting or alternatively by employing a planar flow caster such as described in U.S. Pat. No. 4,142,571. For example, if an aluminum-transition alloy is so cast, it will exhibit a coarse and a fine spatial distribution of a precipitate phases. These regions are illustrated in FIG. 1. The composition of the alloy shown in FIG. 1 was 3.27 Fe, 2.28 Ni, 4.59 Co, and the balance Al (values are given in weight percent). The dark particles in the fine structure 2 are the precipitates and have the structure of $Al_8(Fe,Ni,Co)_2$. The coarse structure 4 where the precipitates are large and at greater separation occurs principally in the extremities of the quenched material (i.e., the periphery of the splat and the edge of the ribbon). In view of this fact it is preferred that the casting of the alloy be in ribbon or more preferably sheet form to minimize the edge effects.

The coarse structure 4 has a lower strength and is more ductile than the fine structure 2. It is this combination of properties of the coarse structure which allows one by grinding to distinguish the regions containing coarse particles from those continuing fine particles. In order to facilitate fracture of the powder rather than ductile deformation during grinding, it is preferred that the hardness of Al-transition metal alloy ribbon be at least VNH of 300 when a load of 10 gms. is applied to the indentor. Table 1 illustrates the grindability as a function of hardness.

TABLE 1

Effect of Hardness on Grindability of Al-transition Metal Alloys

| ALLOY COMP. IN WT. % | | | | AVERAGE HARDNESS | CHARACTER OF GROUND |
|---|---|---|---|---|---|
| Al | Fe | Ni | Co | VHN | PARTICLES |
| Bal | 1.68 | 1.17 | 2.35 | 200 | Agglomerated |
| Bal | 3.27 | 2.28 | 4.59 | 350 | Fractured into fine and coarse particles |
| Bal | 4.77 | 3.33 | 6.50 | 400 | Fractured into fine and coarse particles |

If the overall hardness of the ribbon is too high, the coarse structure 4 and the fine structure 2 will be brittle and there will be no discrimination between the coarse and fine structure. Conversely, if the material is so ductile that it is necessary to work harden the material before the material can be fractured, the resulting particles will incorporate coarse and fine structure. It is therefore preferred for aluminum alloys that the hardness be less than VHN of 400 and preferably greater than 200 when 10 gms. is applied to the indentor.

It has been found that one effective way to produce a bimodal distribution of powder sizes from a material which contains regions of coarse and fine structure is to crush the material in a hammer mill. Preferably the hammer mill should have an exit screen with a minimum opening size of about ⅛ inch. After the material is crushed by the hammer mill, the crushed material is classified into a powder having at most a 35 mesh as determined by screening the material through a screen having a mesh size not greater than 35 mesh.

Figure 2:
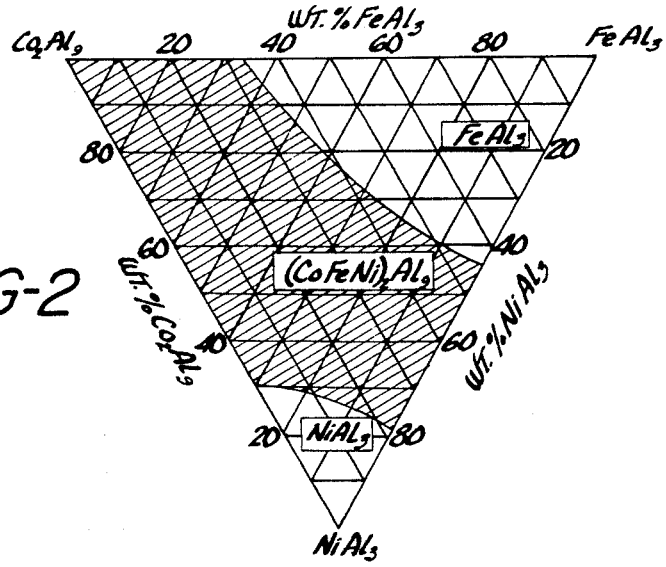
FIG. 2 is a ternary phase diagram for the $Al_8Co_2$-$Al_3Fe$-$Al_3Ni$ system. The shaded region illustrates the composition forming the $Al_8(Fe,Ni,Co)_2$ structure.

The above conditions can be maintained in the aluminum transition metal alloy system providing the ratio of Fe:Co:Ni falls with the shaded region of the $Al_8Co_2$-$Al_3Fe$-$Al_3Ni$ ternary phase diagram shown in FIG. 2. There is the further provision that the alloy have a total Fe+Ni+Co content of between 2.5 and 8 atomic percent (approximately 5 to 16 weight percent).

Figure 3:
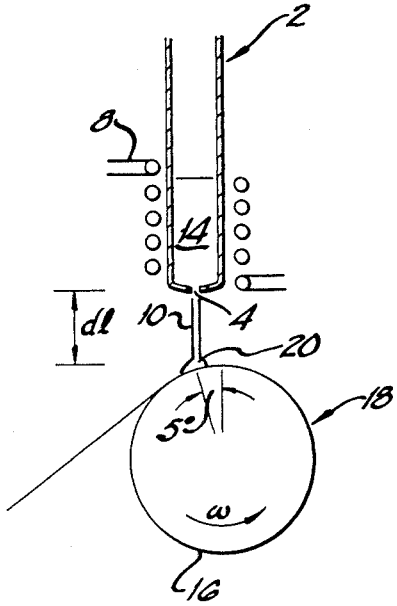
FIG. 3 shows the jet casting system for practicing the present invention.

The aluminum alloys for the examples which follow were cast as ribbon employing a jet caster similar to the one schematically represented in FIG. 3. A quartz crucible 2 having a bottom nozzle 4 was employed. The interior surfaces 6 of the crucible 2 and the nozzle 4 were coated with boron nitride to prevent interaction of the quartz with the aluminum alloy. The alloy was melted with an induction heating element 8. A pressure of from 1–3 psi (7–21 kPa) was maintained above the melt 14 to produce a stream of molten metal 10 which flowed through the nozzle 4. The stream 10 was directed onto the surface 16 of a 12 inch (30.5 cm) diameter CuBe wheel 18. The vertical stream 10 impacts the perimeter 19 of the wheel 18 at a point 20 which is approximately 5° in advance of the highest point in the rotation of the wheel 10 as is illustrated in FIG. 3.

The nozzle to wheel separation, dl, was maintained at about 0.25 inch (0.64 cm). At distances of 0.5 inch (1.27 cm) partial solidification of the stream 10 occurs before contact with the wheel 18 and which deteriorates the quality of the resulting ribbon.

Under the above operating condition, a puddle 22 will form along the perimeter 19 of the wheel 18 which is about 0.25 inch (0.64 cm) in length.

The alloys for the examples were melted from their elemental components. To assure mixing, the alloy was heated 50° C. above the intended casting temperature and argon was bubbled through the melt via the nozzle 4 to assure uniform mixing of the alloy. It was found that when the above mixing procedure was not followed the resulting ribbon was inhomogeneous.

To uniformly distribute and thereby maximize the dissipation of heat, the stream 10 was moved back and forth across the surface 16 of the wheel 18 on a line which was parallel to the axis of the wheel 18.

EXAMPLE 1

Charges of 800 grams of an aluminum alloy having 3.3% Fe, 2.3% Ni, and 4.6% Co by weight (this would represent an alloy addition of approximately 5 atomic percent solute) were prepared. The charges were melted and cast into ribbon in the manner described above. The casting temperature was 1000° C. The resulting ribbon was about (0.4 cm) wide and 40 μm thick. The Vickers microhardness of the ribbon was 375±25 kg/mm², and the ribbon was brittle in nature. The ribbon was then pulverized by several passes through a hammer mill which had a screen with ⅛ inch (0.32 cm) by 178 inch (1.27 cm) rectangular openings. Coarser material was recharged through the mill until all material was reduced to a powder of 35 mesh or less.

About 800 grams of the powder was then vacuum hot pressed at 400° C. into billets with a 50-ton (444,882 N) press. These billets were about 3 inches (7.6 cm) in diameter and about 3.5 inches (8.9 cm) to 4 inches (10.2 cm) long with a density of 87% of theoretical.

The billet was upset in a closed die extrusion press at 400° C. under a pressure of 350 tons (3,113,755 N). The upset 7.6 cm (3 inches) in diameter compact was then extruded in a 350-ton (3,113,755 N) presss into a bar with a 0.25 inch (0.635 cm) by 1.5 inch (3.81 cm) in rectangular cross section.

Figure 4:
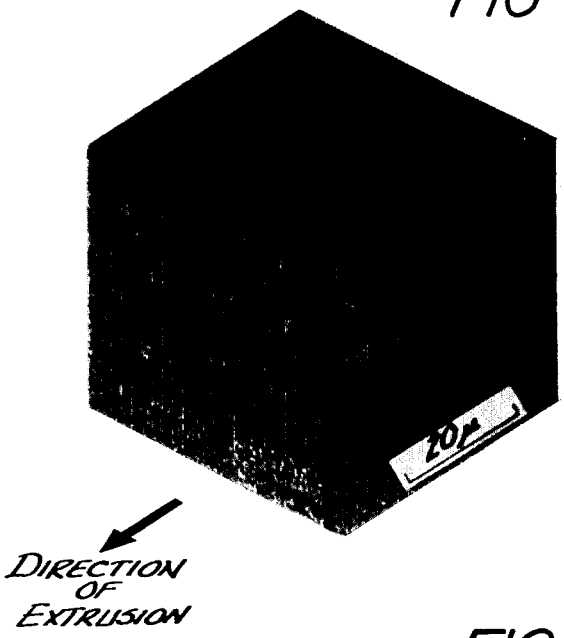
FIG. 4 shows orthogonal sections along the centerline of a bulk sample consolidated from an unscreened powder produced from the ribbon. The microstructure is similar to the microstructure of prior art consolidated powder produced by splat quenching.

The microstructure of the resulting material is illustrated in FIG. 4. This microstructure exhibits regions with a coarse lamellar structure similar to those reported by Sanders et al. and Paris et al. whose work has been discussed in the background art. The physical properties at room temperature of the resulting alloy are summarized in Table 2.

EXAMPLE 2

Charges of 800 grams of the aluminum alloy of Example 1 were cast into ribbon in the manner of Example 1. The ribbon was passed only once through a hammer mill as described in Example 1. The coarse powder, greater than 35 mesh, was separated from the fine powder, less than 35 mesh. The fine powder was then consolidated as follows: first the powder was vacuum hot pressed at 400° C. with 50 tons (444,822 N) pressure, upset at 400° C. in a closed die of the extrusion press of 350 tons (3,113,755 N) to yield a 100% density, and extruded at 475° C. into a 0.25 inch (0.625 cm) by 1.5 inches (3.81 cm) rectangular bar.

Figure 5:
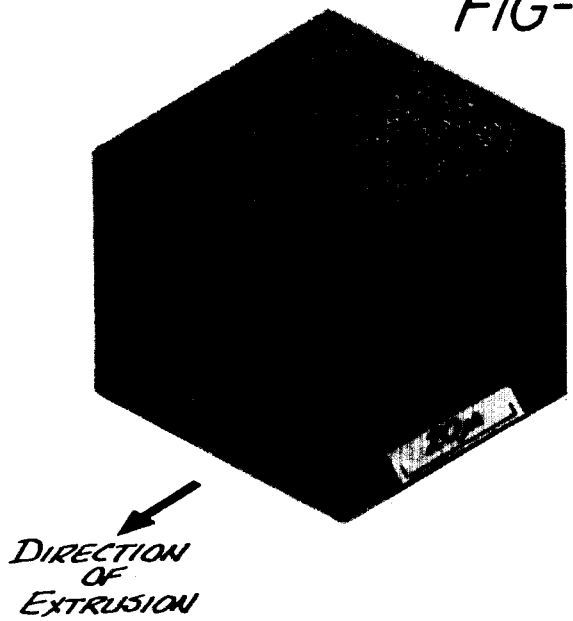
FIG. 5 shows orthogonal sections along the centerline of a bulk sample consolidated from a screened powder produced from ribbon.

The microstructure of the resulting material is illustrated in FIG. 5. This microstructure is homogeneous and free from the coarse lamellar regions which have been reported by Sanders, et al. and Paris et al. works. The physical properties of the resulting alloy at room temperature are summarized in Table 2.

EXAMPLE 3

The unconsolidated coarse powder (+35 mesh) of Example 2 was remilled to reduce in size to −35 mesh and consolidated as set forth in Example 2, with the exception that it was extruded at 450° C. The microstructure of the resulting material is almost identical with FIG. 4, which contains regions of coarse lamellar structure. The physical properties of the alloy at room temperature are summarized in Table 2.

EXAMPLE 4

Charges of 800 grams of an aluminum alloy having 4.77% Fe, 3.33% Ni, and 6.7% Co by weight (this would represent an alloy addition of 7.5 atomic percent) were melted and cast into ribbon in the manner described above. The resulting ribbon was about 0.4 cm wide and 40 μm thick. The Vickers microhardness of the ribbon was 400±25 kg/mm², and the ribbon was brittle in nature. The ribbon was pulverized in a manner similar to Example 2. The coarser particles (greater than +35 mesh) were separated from the fine particles. The fine powder of less than 35 mesh had an identical particle size distribution to that obtained in Example 2. The fine powder was then consolidated as follows: first the powder was vacuum hot pressed at 400° C. with 50 tons (444,822 N) pressure, upset at 400° C. in a closed die of the extrusion machine of 350 tons (3,113,755 N) to yield a 100% density, and extruded at 538° C. to a rectangular bar of 0.25 inch (0.625 cm) by 1.5 inches (3.81 cm) in cross section.

The microstructure of the extruded bulk material is similar the the structure illustrated in FIG. 5 and no regions of coarse lamellars structure were observed. The physical properties of the resulting alloy at room temperature are summarized in Table 2.

EXAMPLE 5

The unconsolidated coarse powder (+35 mesh) of Example 4 was remilled to reduce its size to −35 mesh and consolidated as set forth in Example 4.

The microstructure of the extruded material is similar to FIG. 4, and contains regions of coarse lamellar structure. The physical properties of the alloy at room temperature are summarized in Table 2.

EXAMPLE 6

Aluminum alloy powder produced by the method described in Example 2 was prepared. The alloy had the composition in Example 1. The fine powder was vacuum hot pressed at 350° C. with a 50-ton (444,822 N) press to a density of approximately 73%. The preformed slug 3 inch (7.62 cm) in diameter was then extruded at 350° C. into a 2 inch (5.08 cm) diameter round rod to full density. The extruded round rod was then re-extruded at 350° C. into a rectangular section 0.1875 inch (0.397 cm) by 1.25 inch (3.81 cm). The microstructure of the extruded material was homogenous and similar to the microstructure of FIG. 5. The mechanical properties of the extruded material are summarized in Table 2.

EXAMPLE 7

Aluminum alloy powder produced by the method described in Example 2 was prepared. The alloy had the composition in Example 1. The fine powder was fabricated as follows. The powder was vacuum hot pressed at 375° C. with a 50-ton (444,822 N) press to a density of approximately 73%. The preformed slug 3 inch (7.62 cm) in diameter) was then extruded at 375° C. into a 2 inch (5.08 cm) diameter round rod to full density. The extruded round rod was then re-extruded at 375° C. into a rectangular section 0.1875 inch (0.476 cm) by 1.25 inch (3.18 cm). The microstructure of the extruded material was homogeneous and similar to the microstructure of FIG. 5. The mechanical properties of the extruded material are summarized in Table 2.

EXAMPLE 8

Fine powder as described in Example 4 was fabricated as described in Example 7. The microstructure of the extruded material was homogeneous and similar to the microstructure of FIG. 5. The mechanical properties of the extruded material are reported in Table 2.

Figure 6:
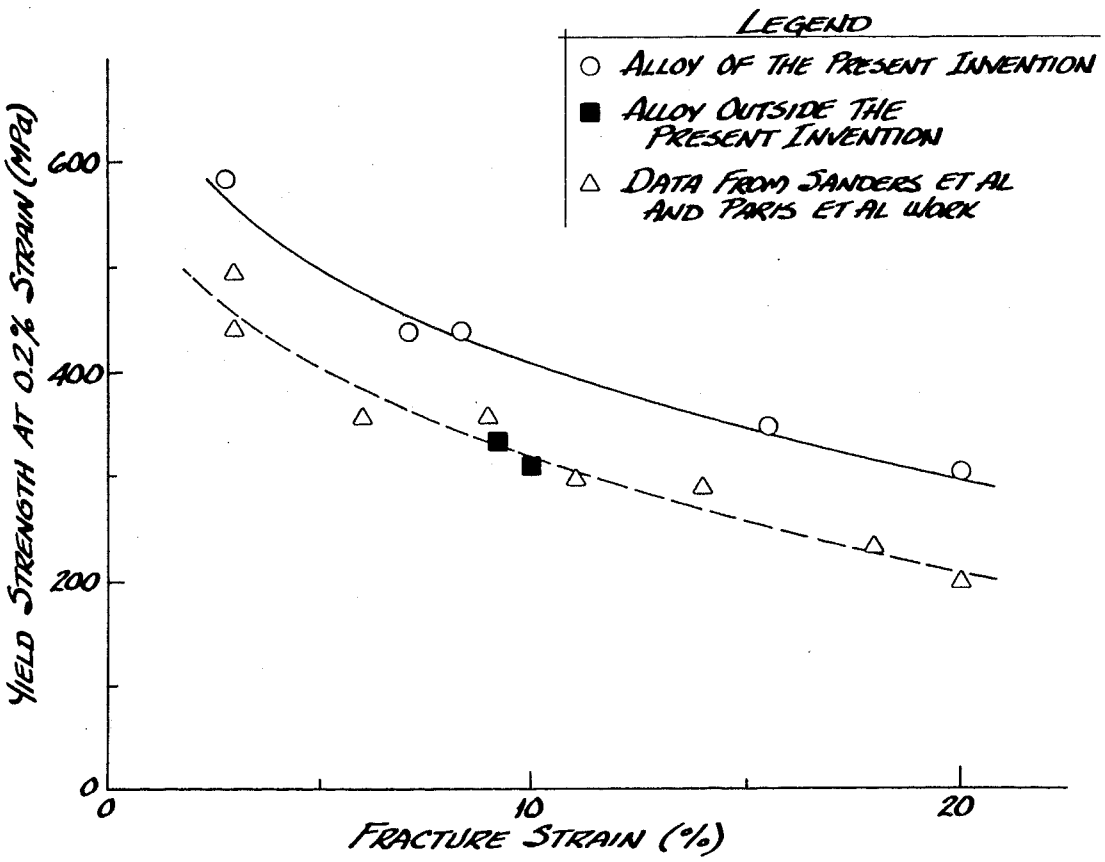
FIG. 6 shows comparative mechanical properties of consolidated product.

In order to assist in a interpretation of the above data, the yield strengths have been plotted as a function of the fracture strain in FIG. 6. Example 1 and 5 which do not fall within the scope of the invention are plotted with open boxes while the examples within the scope of the invention are plotted with solid circles.

The data reported by Sanders et al. and Davis et al. for Al-transister alloys is plotted with open triangles. As can be seen the consolidation procedures employed produced results similar to the prior art work when the powder was not processed by the method of the present invention.

On the other hand, when the method of the present invention is employed one eliminates the coarse particles in the microstructure and produces a homogeneous microstructure which has an improved combination of strength and ductility.

TABLE 2

Physical Properties of the Consolidated Aluminum Powders of Example 1-8

| Example | Density ($g/cm^3$) +0.02 | Hardness $R_B$ | Yield at 0.2% (MPA) | VTS (MPA) | Elongation (%) |
|---|---|---|---|---|---|
| 1 | 2.90 | 64 | 308 | 367 | 10.0 |
| 2 | 2.91 | 64 | 302 | 349 | 20.1 |
| 3 | 2.92 | 63 | 311 | 346 | 15.4 |
| 4 | 3.04 | 76 | 438 | 472 | 7.1 |
| 5 | 3.05 | 71 | 336 | 404 | 9.1 |
| 6 | 2.91 | 96 | 432 | 460 | 7.8 |
| 7 | 2.91 | 97 | 385 | 418 | 10.6 |
| 8 | 3.04 | 105 | 568 | 589 | 1.9 |

The above described separation process for increasing the strength of rapidly solidified Al alloy powders has been described by way of examples from the Al-transition alloy system. However, it should be understood that the process is applicable to other Al-alloy systems where rapid solidification processing results in variable microstructure. In general, these aluminum alloys will contain elements with limited solubility and diffusivity.

What we claim is:

1. An improved method for producing rapidly solidified aluminum alloy powder from material which has been quenched on a chill surface, the material having regions with coarse microstructure and regions with fine microstructure, the improvement comprising:

grinding said material to develop a fractured powder having a coarse powder component with said coarse microstructure and a fine powder component with said fine microstructure; and screening said powder to remove said coarse powder component.

2. The method of claim 1 wherein the quenched material is cast in continuous form on a chill surface.

3. The method of claim 2 wherein said grinding is accomplished by a hammer mill with an exit screen having opening with a minimum dimension of about ⅛ inch (0.318 cm), and said screening is accomplished with a screen having a mesh size not greater than about 35 mesh.

4. The improved method of claim 3 wherein the variable structure material has a hardness between about 200 VHN and 400 VHN.

5. The improved method of claim 4 wherein the alloy essentially consists of the formula:

$$Al_{bal}Fe_aNi_bCo_c$$

where a, b, and c are wt% of the elements and with the proviso that the sum of a, b, and c be between about 5% and 16%.

6. The improved method of claim 4 with the additional proviso that the ratio of a, b, and c assure the formation of the $Al_g(Fe, Ni, Co)_2$ precipitate.

7. A powder produced by the methods of claims 1, 2, 3, 4, 5 or 6.

8. An article of manufacture produced from the powder of claim 7.

* * * * *